United States Patent [19]

Karlsson

[11] 4,427,054

[45] Jan. 24, 1984

[54] ROTARY REGENERATIVE HEAT EXCHANGER AND METHOD OF OPERATING SAME

[75] Inventor: Kurt Karlsson, Tyresö, Sweden

[73] Assignee: Svenska Rotor Maskiner Aktiebolag, Stockholm, Sweden

[21] Appl. No.: 416,314

[22] Filed: Sep. 9, 1982

[30] Foreign Application Priority Data

Sep. 9, 1981 [SE] Sweden ..... 8105371

[51] Int. Cl.[3] ..... F28D 19/00

[52] U.S. Cl. ..... 165/1; 165/5; 165/9

[58] Field of Search ..... 165/7, 9, 5, 1

[56] References Cited

U.S. PATENT DOCUMENTS 3,315,729 4/1967 Mondt ..... 165/9
3,338,300 8/1967 Turunen et al. ..... 165/9 X
3,587,723 6/1971 Norback ..... 165/5
3,695,250 10/1972 Rohrs et al. ..... 165/10 X

*Primary Examiner*—Albert W. Davis, Jr.
*Attorney, Agent, or Firm*—Frishauf, Holtz, Goodman and Woodward

[57] ABSTRACT

A rotary regenerative heat exchanger comprises a plurality of moving sector-like rotor compartments carrying regenerative heat exchange material, in which leakage of a gaseous medium having a lower pressure and being trapped by a stationary section plate in the sector-like compartments to a gaseous medium of a higher pressure is at least reduced by the provision of a means for adjusting the sector plate to such an axial clearance with respect to the end of the rotor that an intentional amount of direct leakage of the high pressure medium is maintained between the rotor end and the sector plate, giving rise to forcing out the low pressure medium from compartments that are about to leave the low pressure medium passage and replacing it with high pressure medium.

2 Claims, 1 Drawing Figure

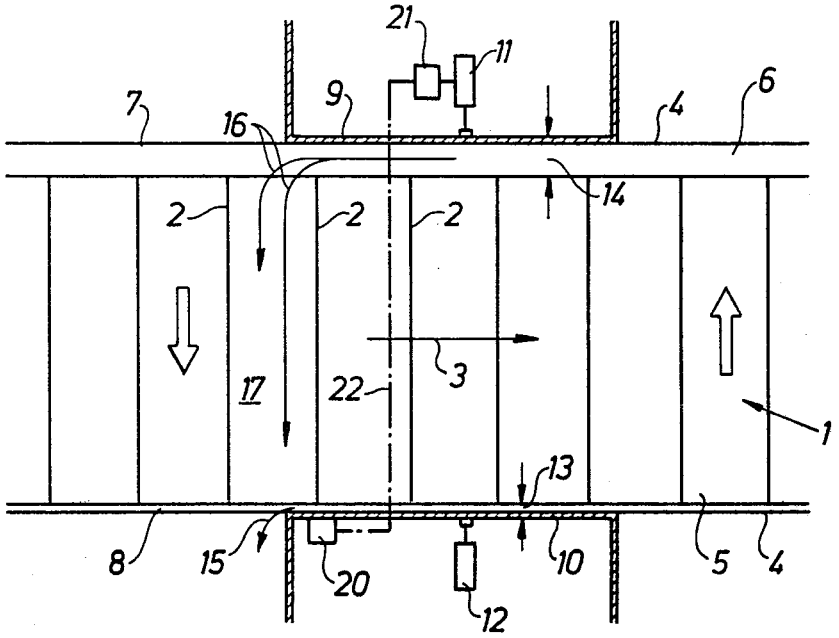
21
11
7
9
16
4
6
14
2
2
2
3
17
22
1
13
8
15
20
10
5
4
12

ROTARY REGENERATIVE HEAT EXCHANGER AND METHOD OF OPERATING SAME

This invention relates to a rotary regenerative heat exchanger for gaseous media and a method of operating same, the rotary regenerative heat exchanger comprising a rotor having a plurality of sector-like compartments carrying regenerative heat exchange material, a stationary structure comprising a casing for said rotor and end plates having inlet and outlet openings separated by adjustable sector plates providing two passages through said heat exchanger between said openings for flow in countercurrent direction of a primary gaseous medium to be heated and a secondary gaseous medium to be cooled of different pressure than said primary medium, respectively, and means for at least reducing leakage of the gaseous medium having the lower pressure, trapped in the sector-like compartments, to the gaseous medium having the higher pressure.

Means for eliminating entrained leakage via the sector-like compartments of the rotor are known in connection with air preheaters. Said means comprise pipings including fans and are arranged to move air by suction from a suitable place in the air preheater to the sector-like compartments in which gas is entrained in order to replace said entrained gas with air before said compartments enter the passage for air, for instance as is shown in U.S. Pat. No. 2,829,616.

Means of this type for eliminating entrained leakage are very space consuming and cannot be incorporated with an existing regenerative heat exchanger in an easy way.

An object of the present invention is to provide a more favorable solution to this problem, such as to enable in an easy way an improvement of existing heat exchangers of this type.

SUMMARY OF THE INVENTION

This object is achieved by means of the invention, which is characterized by means and a method for adjusting the sector plate positioned between the inlet opening of the low pressure medium and the outlet opening of the high pressure medium to such an axial clearance with respect to the corresponding end of the rotor that an intentional amount of direct leakage of the high pressure medium is maintained between the rotor end and said adjustable sector plate, giving rise to forcing out the low pressure medium from each compartment that is about to leave the low pressure medium passage and replacing it with high pressure medium.

A preferred embodiment of the invention is characterized by a low pressure medium tracing device positioned close to the outlet opening of the low pressure medium flow and the portion of the sector plate where the sector-like compartments move towards the high pressure medium flow, the sector plate adjusting means being controlled by said low pressure medium tracing device such that said clearance is increased/decreased when presence or absence, respectively, of said low pressure medium is indicated.

Thus, by means of the invention the improvement is achieved that the non-desirous entrained leakage can be eliminated simply by increasing the clearance of a sector plate as compared with the smallest possible clearance usually strived for. Moreover, no space-consuming pipings or ducts and fans are required which considerably facilitates the incorporating of the invention with existing heat exchangers.

BRIEF DESCRIPTION OF THE DRAWING

The invention will be explained in more detail hereinafter with reference to the single FIGURE schematically showing by way of example an air preheater rotor illustrated in the form of a development of the peripheral surface of the rotor, in the plane of the paper, together with its sector plates and means for adjusting the sector plates in the axial direction of the rotor.

DETAILED DESCRIPTION

In the drawing there is shown a rotor 1 which is subdivided into sector-like compartments by partition walls 2 and which is rotatably journalled in a stationary structure comprising a casing and end plates 4 having an inlet opening 5 and an outlet opening 6 for air flow as well as an inlet opening 7 and an outlet opening 8 for gas flow. The rotor compartments are assumed to move from left to right, as indicated by an arrow 3. The openings 6, 7 and openings 5, 8, respectively, of each end plate 4 are separated by sector plates 9, 10, which are adjusted by adjusting means 11, 12 to suitable clearances 13, 14 with respect to the ends of the rotor.

Clearance 13 is as small as possible for reducing the air leakage (arrow 15) from the air passage between openings 5–6 to the gas passage between openings 7–8, the pressure of the air flow being higher than that of the gas flow. Clearance 14, on the other hand, is considerably larger and is adjusted such that an intentional leakage (arrows 16) is maintained which gradually forces the gas out of a sector-like compartment 17 before this compartment after passing between the sector plates 9, 10 opens towards the air passage between openings 5–6. Accordingly, the entrained volume moved from the gas passage to the air passage mainly consists of pure air.

With knowledge of the data of the heat exchanger and the prevailing pressure difference it is easy to estimate the clearance 14 required. A more precise method is, however, to place a device 20 for tracing the presence of the low pressure medium, for instance combustion gas, close to the outlet opening of the low pressure medium and the portion of the sector plate 10 where the sector-like compartments move towards the high pressure medium flow between the openings 5 and 6. The tracing device 20 is connected to a control device 21, known per se, of the adjusting device 11 for adjusting the clearance 14, the different parts of this control circuit 22 being designed to increase the clearance 14 when the tracing device 20 indicates the presence of the low pressure medium, and to decrease said clearance 14 when no such indication is present. The described method will give a clean high pressure medium, e.g. air, with no admixture of the low pressure medium, e.g. gas, at the outlet opening 6 of the high pressure medium.

I claim:

1. Rotary regenerative heat exchanger for gaseous media comprising a rotor having a plurality of sector-like compartments carrying regenerative heat exchange material, a stationary structure comprising a casing for said rotor and end plates having inlet and outlet openings separated by first and second adjustable sector plates providing two passages through said heat exchanger between said openings for flow in countercurrent direction of a primary gaseous medium to be heated and a secondary gaseous medium to be cooled of different pressure than said primary medium, respectively, and means for at least reducing leakage of the gaseous medium having a lower pressure, trapped in the sector-like compartments, to the gaseous medium having the higher pressure, the improvement wherein:

said leakage reducing means comprises sector plate adjusting means (11) for adjusting said first adjustable sector plate (9) which is positioned between the inlet opening (7) of the low pressure medium and the outlet opening (6) of the high pressure medium to such an axial clearance (14) with respect to the corresponding end of the rotor that an intentional amount of leakage (16) of the high pressure medium is maintained between the rotor end and said first adjustable sector plate (9), giving rise to forcing out the low pressure medium from each compartment (17) that is about to leave the low pressure medium passage and replacing it with high pressure medium;

a low pressure medium tracing device (20) is positioned close to the outlet opening (8) of the low pressure medium flow and the portion of the second sector plate (10) where the sector-like compartments (17) move towards the high pressure medium flow; and said sector plate adjusting means (11) is coupled to and controlled by said low pressure medium tracing device (20) such that said clearance (14) is increased/decreased when presence or absence, respectively, of said low pressure medium is indicated by said low pressure medium tracing device (20).

2. In a rotary regenerative heat exchanger for gaseous media comprising a rotor having a plurality of sector-like compartments carrying regenerative heat exchange material, a stationary structure comprising a casing for said rotor and end plates having inlet and outlet openings separated by first and second adjustable sector plates providing two passages through said heat exchanger between said openings for flow in countercurrent direction of a primary gaseous medium to be heated and a secondary gaseous medium to be cooled of different pressure than said primary medium, respectively, a method of at least reducing leakage of the gaseous medium having the lower pressure, trapped in the sector-like compartments, to the gaseous medium having the higher pressure, said method comprising:

adjusting said first adjustable sector plate (9) which is positioned between the inlet opening (7) of the low pressure medium and the outlet opening (6) of the high pressure medium to such an axial clearance (14) with respect to the corresponding end of the rotor that an intentional amount of direct leakage (16) of the high pressure medium is maintained between the rotor end and said first adjustable sector plate (9), thereby forcing out the low pressure medium from each compartment (17) that is about to leave the low pressure medium passage and replacing it with high pressure medium;

positioning a pressure medium tracing device (20) close to the outlet opening (8) of the low pressure medium flow and the portion of the second sector plate (10) where the sector-like compartments (17) move towards the high pressure medium flow; and controlling said adjusting of said first adjustable sector plate by said low pressure medium tracing device (20) such that said clearance (14) is increased/decreased when presence or absence, respectively, of said low pressure medium is indicated by said low pressure medium tracing device (20).

* * * * *